United States Patent [19]

Graillat

[11] Patent Number: 4,909,531

[45] Date of Patent: Mar. 20, 1990

[54] METATARSAL SLANT

[75] Inventor: Gerard Graillat, Annecy, France

[73] Assignee: Salomon S.A., Annecy Cedex, France

[21] Appl. No.: 306,281

[22] Filed: Feb. 2, 1989

Related U.S. Application Data

[63] Continuation of Ser. No. 27,971, Mar. 19, 1987, abandoned.

[51] Int. Cl.[4] ..... A63C 9/18

[52] U.S. Cl. ..... 280/615

[58] Field of Search ..... 280/615, 623, 625, 627, 280/635, 636, 613, 614, 618

[56] References Cited

U.S. PATENT DOCUMENTS

| | | | |
|---|---|---|---|
| 2,682,415 | 6/1954 | With | 280/615 |
| 3,850,439 | 11/1974 | Guttulsrud | 280/615 |
| 4,153,271 | 5/1979 | Buttner | 280/615 |

FOREIGN PATENT DOCUMENTS

| | | | |
|---|---|---|---|
| 65020 | 7/1942 | Norway | 280/623 |
| 593077 | 11/1977 | Switzerland | 280/615 |
| 86/04825 | 8/1986 | World Int. Prop. O. | 280/615 |

*Primary Examiner*—Charles A. Marmor
*Assistant Examiner*—Tamara L. Finlay
*Attorney, Agent, or Firm*—Pollock, Vande Sande & Priddy

[57] ABSTRACT

Device for holding a cross-country ski boot against the upper surface of a ski, while permitting the rear portion of the boot not only to be raised, but simultaneously to pivot about an axis of rotation which progressively shifts from being substantially perpendicular to the longitudinal axis of the ski, to extending in an oblique direction which is substantially parallel to the axis of the metatarsal-phalangeal joint of the skier's foot. The arrangement accommodates execution of the so-called "skater half step."

12 Claims, 3 Drawing Sheets

METATARSAL SLANT

This application is a continuation of application Ser. No. 027,971, filed Mar. 19, 1987 now abandoned.

FIELD OF THE INVENTION

This invention pertains to a device for holding the front part of a boot on a ski, especially a cross crountry ski, allowing the skier to raise his heel by flexion of his foot.

PRIOR ART

Devices are already known which hold the front of a boot on a ski and which allow the heel to be raised, especially for cross country skiing, and which are designed to hold the front part of the boot against the ski in the zone extending from the front end of the boot to approximately the end of the metatarsals of the skier's foot, i.e., up to the zone in which the phalanges and the metatarsals of the foot meet, or the metatarsal-phalangeal joint. For example, the devices disclosed in German Utility Model Registration No. 77 23 934 and German Patent 2 199 153 hold the front of the boot in a symmetrical manner, which makes it possible to raise the heel by flexion of the foot around a rotation axis perpendicular to the longitudinal axis of the ski. This traditional position of the rotational axis parallel to the surface of the ski and perpendicular to its longitudinal plane of symmetry appeared to be the best adapted for executing the steps in cross country skiing.

However, with the new "skater half step" cross country ski technique, it was noted that the direction of the rotational axis of the skier's foot moves substantially during execution of the skier's restart step, especially when the skier bears upon the inside of the foot to propel himself forward.

SUMMARY OF THE INVENTION

An object of this invention is to provide a holding device of the aforementioned type which allows the displacement of the rotational axis of the skier's foot during execution of the "skater half step", hence facilitating use of this technique in cross country skiing.

For this purpose, the device for holding the front part of a ski boot, especially a cross country ski boot, allowing the skier's heel to be raised by flexion of his foot around a rotational axis which is transverse with respect to the longitudinal axis of the ski, comprises holding means rigidly applying the front part of the sole of the boot flat against the upper surface of the ski, in a holding zone extending between the front end of the sole and a rear limit located substantially under the metatarsal-phalangeal joint of the foot, these holding means determining, in cooperation with the corresponding parts of the boot, the rotational axis of the rear part of the boot and especially of the heel in the direction of its extreme raised position, so that, at the end of raising of the foot, the rotational axis extends in an oblique direction with respect to the longitudinal axis of the ski, this oblique direction being substantially parallel to the axis of the metatarsal-phalangeal joint of the foot.

The holding device according to the invention thus allows a variation of the direction of the rotational axis of the skier's heel, when it is being raised with respect to the front part of the foot, from a direction perpendicular to the longitudinal axis of symmetry of the ski when the foot is resting flat on the ski, up to an oblique line substantially parallel to the metatarsal-phalangeal joint of the foot when the heel is completely raised.

BRIEF DESCRIPTION OF THE DRAWINGS

In order that the invention may be more clearly understood, reference will now be made to the accompanying drawings, in which several embodiments of the invention are shown for purposes of illustration, and in which.

DESCRIPTION OF PREFERRED EMBODIMENTS

Figure 1:
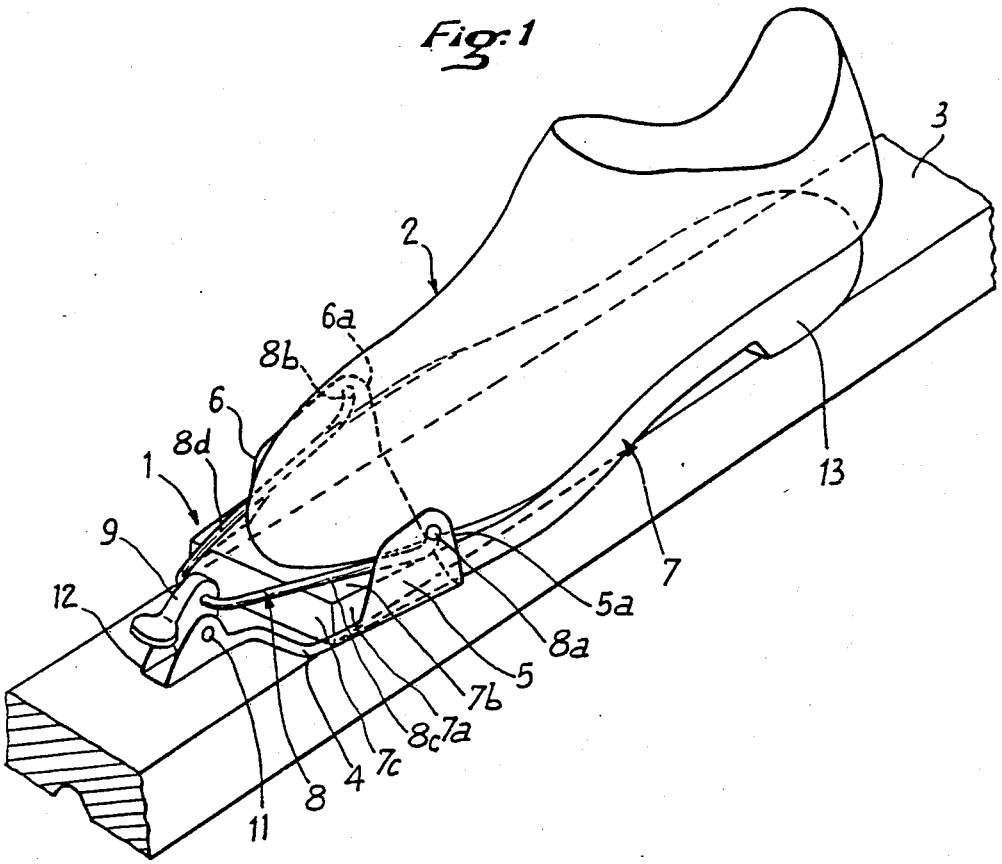
FIG. 1 is a perspective view of a device for holding the front of a boot on a cross country ski, according to the invention, with the boot resting flat on the ski.
Figure 2:
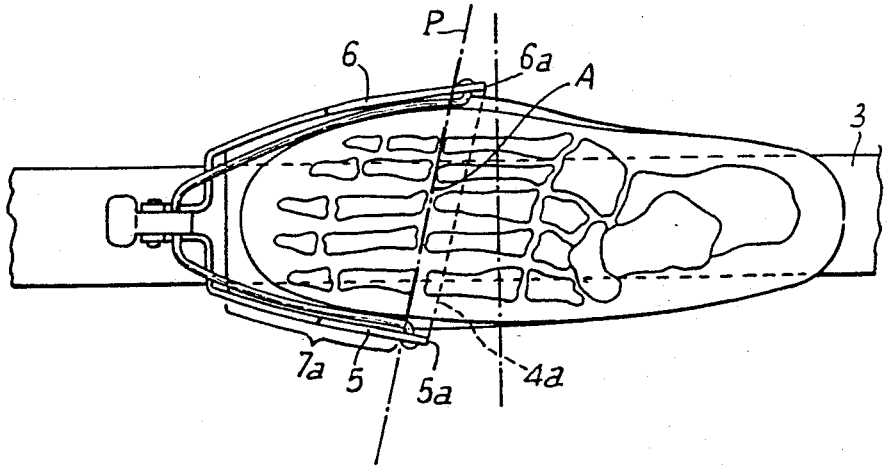
FIG. 2 is a plan view of the holding device of FIG. 1.

The device 1 for holding the front of a boot 2 on a cross country ski 3 shown in FIGS. 1 and 2 comprises a plate 4 constituting a seating and fastened to the ski with screws. This seating 4 in its rear part has two vertical wings 5 and 6 which extend upward from the edges of the plate forming the seating 4, which overhangs edges of the ski 3. The front part *7a* of the sole 7 of the boot is held on the seating 4 of the holding device by means of a U-shaped spring 8 which is open towards the rear and whose ends *8a*, and *8b* cambered in the appropriate manner, are engaged in holes provided respectively in the upper parts of the wings 5 and 6 in order to constitute pivoting axes for the spring 8. Wing 5 is the inside wing, i.e., that which faces the other ski (not shown), while the other wing 6 is located on the outside of the ski. The highest point of the spring 8, i.e., its central front part, crosses a locking lever 9 mounted in a pivoting manner around a horizontal and transverse axis 11, on a cap 12 extending the seating 4 forward.

When the boot 2 is held on the ski 3, as shown in FIGS. 1 and 2, the two branches *8c* and *8d* of the spring 8 which extend towards the rear are held pressed on the upper surface *7b* of the sole 7, on both sides of the upper of the boot 2.

As can be seen in FIGS. 1 and 2, the holding device 1 is arranged so that it rigidly holds the front part *7a* of the sole 7 of the boot 2 on the upper surface of the ski 3, from the frontal end or surface *7c* of the sole up to the rear limit defined by the vertical plane P indicated in chain dotted lines in FIG. 2. Because of this, when the skier raises his foot during cross country skiing, the rotational axis of the heel 13 of said foot moves rather than remaining fixed in space. In other words, at the very beginning of the raising of the heel 13, the rotational axis is perpendicular to the longitudinal axis of symmetry of the ski 3 and is contained approximately in a transverse plane $P_1$ shown in FIG. 2. Gradually along with the rolling of the foot, i.e., the raising of the heel 13, this rotational axis moves progressively from plane $P_1$ to the aformentioned plane P. This plane P has the special characteristic of passing substantially through the area in which the phalanges and the metatarsals of the foot meet, a zone which constitutes the metatarsal-phalangeal joint A shown in heavy dashes in FIG. 2. Consequently, at the end of the rolling movement of the foot, i.e., when the heel 13 is raised to the maximum with respect to the ski 3, the rotational axis of the skier's foot is parallel to the metatarsal-phalangeal joint A.

To obtain this inclination of the rotational axis of the foot and the boot at the end of raising of the heel 13, the holding device 1 is arranged so as to define a rear limit of the holding zone which is inclined with respect to the longitudinal axis of the ski, from the outside of the ski towards the inside and from the rear to the front. This is reflected by the fact that the rear edge 6*a* of the outside wing 6 of the seating 4 is offset towards the rear with respect to the rear edge 5*a* of the inside wing 5. Consequently, the rear edge 4*a* of the seating 4, which extends between the rear edges 5*a* and 6*a* of the wings 5, 6, is itself inclined with respect to the longitudinal axis of the ski, while being substantially parallel to plane P containing the metatarsal-phalangeal joint A.

Figure 3:
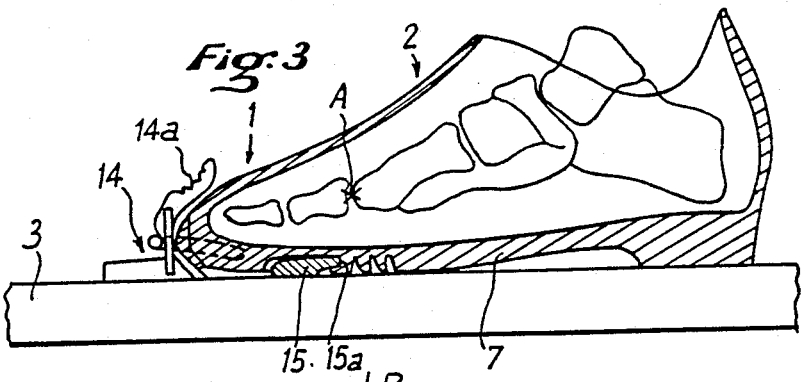
FIG. 3 is a vertical and longitudinal cross section of a second embodiment of the invention.
Figure 4:
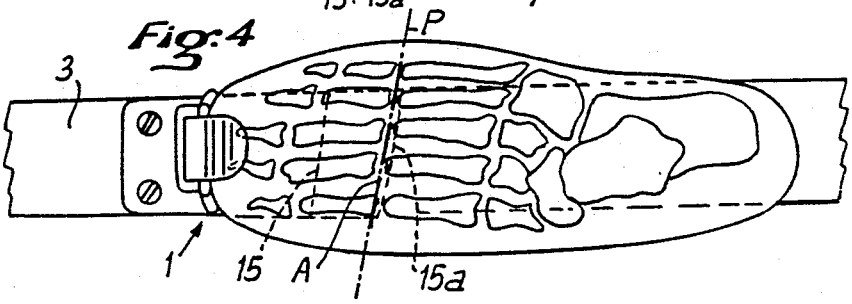
FIG. 4 is a plan view of a holding device shown in FIG. 3.

In the embodiment of the invention shown in FIGS. 3 and 4, the holding device 1 is comprised of two elements, namely a front binding 14 holding the front end of the boot, and a rear fastening block 15 attached to the upper surface of the ski and cooperating with a corresponding part of the sole 7 of the boot. The binding 14 is provided with a lock lever 14*a* mounted in a pivoting manner so that it can exert forward traction on the boot. Moreover, the fastening block 15 comprises a rear and upper edge 15*a* which extends in an overhanging manner towards the rear and which engages in a groove having the same shape provided in the sole 7 of the boot. This rear edge 15*a* is inclined in a horizontal plane with respect to the longitudinal axis of the ski so as to be contained in the vertical plane P passing through the metatarsal-phalangeal joint A of the skier's foot, or parallel and near this plane. The boot is held in place on the ski by engaging forward so that the groove of the sole fits over the edge 15*a* of the block 15, after which the lock lever 14*a* is pivoted so as to exert forward traction on the boot and thus tightly secure the sole 7 to the fastening block 15.

Figure 5:
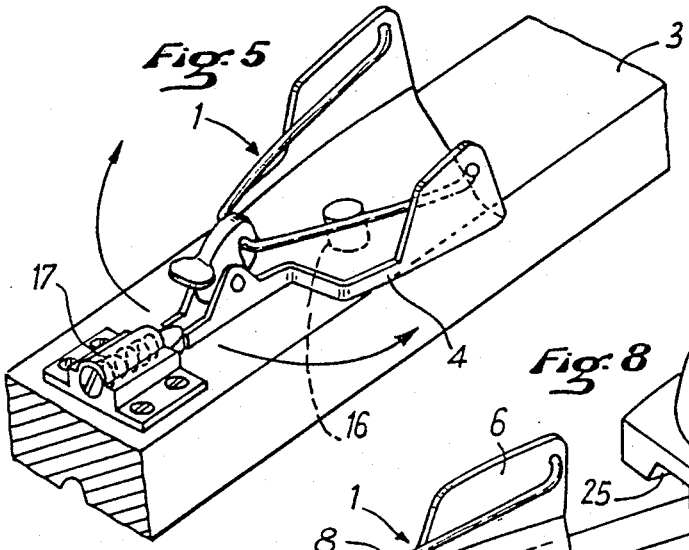
FIG. 5 is a perspective view of a third embodiment of the holding device according to the invention, allowing lateral release.

In the embodiment of the invention shown in FIG. 5, the holding device 1 is of the releasable type to make it possible to release the boot in case the skier falls or applies dangerous stress at the level of the boot. In this case, the seating 4 of the holding device 1 is mounted for rotation on the ski 3, about an axis 16 perpendicular to the ski, and the front part of the seating 4 is held in locked position by means of an elastic locking device 17 of any known type, fastened to the ski.

Figure 6:
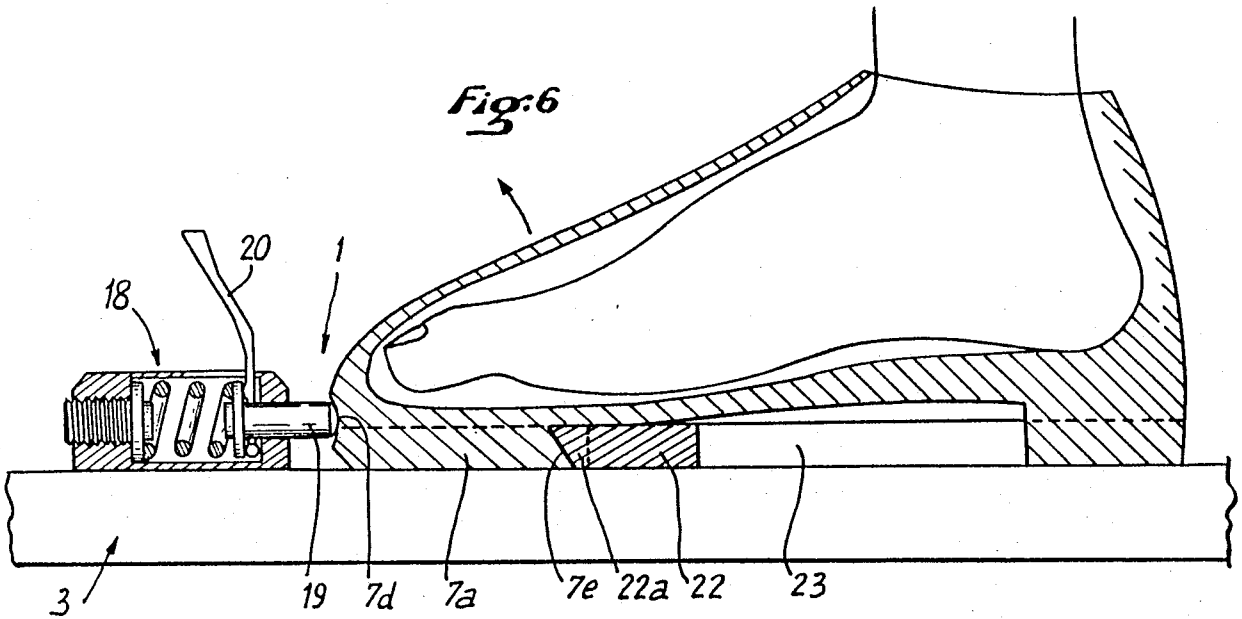
FIG. 6 is a longitudinal and vertical cross section of a fourth embodiment of the invention, along line VI—VI in FIG. 7.
Figure 7:
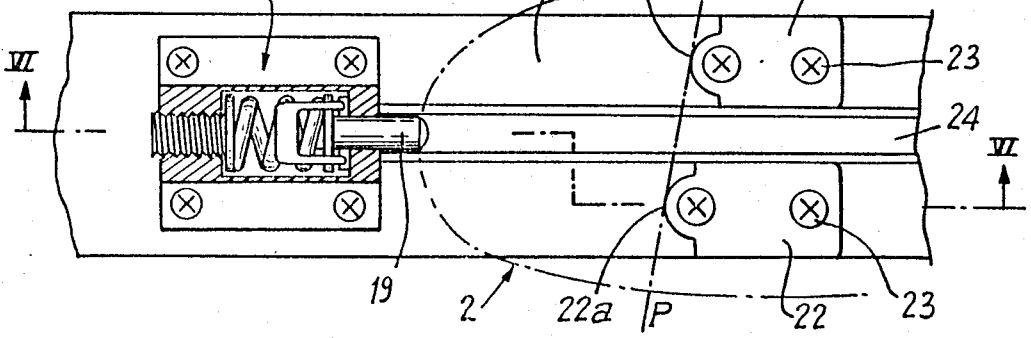
FIG. 7 is a plan view of the holding device shown in FIG. 6.

In the embodiment of the invention shown in FIGS. 6 and 7, the holding device 1 is mounted on a ski 3 having on its upper surface a longitudinal rib 24 for guiding and centering the boot. It comprises a front stop 18 having a tappet 19 solicited elastically towards the rear which can be pulled back in the forward direction by means of a release lever 20 and which engages in a corresponding depression 7*d* provided in the front end of the sole 7 of the boot. The elastically solicited tappet 19 consequently pushes the front part 7*a* of the sole back towards one or several rear fastening blocks attached to the ski.

FIG. 7 shows that the sole 7 of the boot is held pressed towards the rear by its face, transverse 7*e* constituting the rear limit of its front part 7*a*, on two separate fastening blocks 21, 22, namely, an outer fastening block 21 and an inner fastening block 22, both blocks being attached to the ski by screws 23 such that their respective front surfaces 21*a* and 22*a*, against which the rear transverse surface 7*e* of the front part 7*a* of the sole abuts are offset with respect to each other in the longitudinal direction. More specifically, the front support surface 21*a* of the outer fastening block 21 is located more towards the rear with respect to the front support surface 22*a* of the inner fastening block 22. Support surfaces 21*a* and 22*a* are advantageously in the form of bosses with convexities facing towards the front, and as such jointly defining a support plane P, tangent to the two bosses 21*a*, 22*a*, which forms the rear limit of the holding zone for the front part 6*a* of the sole 7, and which substantially contains the metatarsal-phalangeal joint of the foot. To promote the locking of the sole 7 on the rear blocks 21, 22, the rear transverse surface 7*e* of the sole 7 and the front support surfaces 21*a*, 22*a* of the fastening blocks 21, 22 are inclined from bottom to top and from rear to front.

Figure 8:
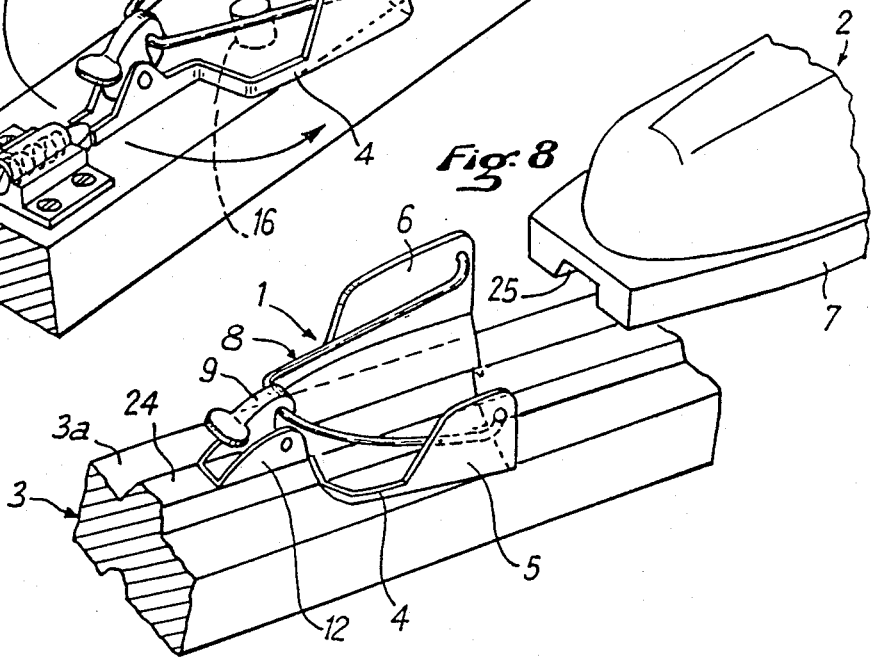
FIG. 8 is a perspective view of a fifth embodiment of the holding device according to the invention.

In the case of a ski having a flat upper surface, the two rear fastening blocks 21 and 22 may be replaced with a single block, having a front support surface which is inclined and contained in plane P. The use of two separate fastening blocks 21 and 22 is necessary only when the holding device according to the invention is used with a ski having a longitudinal guiding and centering rib as illustrated in FIG. 8. In the embodiment illustrated in FIG. 8, the holding device 1 which is of the type shown in FIGS. 1 and 2, is mounted on a ski 3 having a longitudinal rib 24 for guiding and centering the boot 2, the sole 7 of which has a corresponding longitudinal groove 25. In this case, the seating 4 is conformed so that it complements the shape of the guide rib 24. The front cap 12 which extends the seating 4 is attached to the upper surface of the guide rib 24, while the rear parts of the seating 4 from which wings 5 and 6 issue are attached to the upper surface 3*a* of the ski 3, on both sides of the rib 24.

The invention is not limited to the embodiments described above. The holding zone for the front part (7*a*) of the sole 7 up to a rear limit, the maximum of which can be located at the level of the metatarsal-phalangeal joint area A of the skier's foot, as described above, may also be located at a distance smaller than that between A and the front end of the sole.

What is claimed is:

1. Device for holding a boot having a front part, a rear part and a sole, on an upper surface of a ski having a longitudinal axis, said device comprising holding means rigidly applying said front part flat against said upper surface of said ski, in a holding zone located between a front end of said sole and a rear limit located substantially in a vertical plane oblique to said longitudinal axis of said ski and passing through a metatarsal-phalangeal joint area of a skier's foot, said holding means in cooperation with corresponding parts of said boot allowing said rear part of said boot to be initially raised about a transverse rotational axis, and then constraining it to simultaneously pivot progressively from said transverse rotational axis to said rear limit.

2. Device according to claim 1, further comprising two elements, namely, a front binding (14), holding the front part of the boot, and at least one rear fastening block (15) attached to the upper surface of the ski and cooperating with a corresponding part of the sole (7) of the boot, said front binding (14) having a pivotally mounted lock lever (14*a*) exerting forward traction on the boot, and said at least one rear fastening block (15) comprises a rear edge (15*a*) which is inclined with respect to the longitudinal axis of the ski so as to be contained in the vertical phase (P) passing through said metatarsal-phalangeal joint area (A) of the skier's foot.

3. Device according to claim 1, further comprising a plate (4) constituting a seating having lateral edges from rear parts or which vertical inside and outside wings (5, 6) extend upwardly, said holding means (8) holding said front part (7*a*) of and sole (7) of said boot on said seating (4), a rear edge (6*a*) of said outer wing (6) of said seating (4) being offset towards the rear with respect to a rear edge (5*a*) of said inner wing (5), whereby a rear edge (4*a*) of said seating (4) which extends between said rear edges (5*a*, 6*a*) of said wings (5, 6) is itself inclined with respect to said longitudinal axis of said ski, while being substantially parallel to said plane (P) passing through said metatarsal-phalangeal joint (A).

4. Device according to claim 3, wherein said seating (4) is attached to said ski (3).

5. Device according to claim 3, wherein said seating (4) is mounted for rotation on the ski (3) about an axis (16) perpendicular to this ski, and the front part of said setting (4) is held in locked position by means of an elastic locking device (17).

6. Device according to claim 1, further comprising a front stop (18) having a tappet (19) solicited elastically towards the rear, said tappet being adapted to be pushed back towards the front by means of a release lever (20) and engaging in a depression (7*d*) provided in the front part of the sole (7) of the boot, and at least one rear fastening block (21, 22) against which a rear transverse surface (7*e*) of said front part (7*a*) of the sole presses.

7. Device according to claim 6, wherein the rear transverse surface (7*e*) of the sole (7) and front support surfaces (21*a*, 22*a*) of said at least one rear fastening block (21, 22) are inclined from bottom to top and from back to front.

8. Device according to claim 7, wherein the front support surface (21*a*) of said at least one rear fastening block (21) located on an outer side of the ski is positioned more towards the rear with respect to the front support surface (22*a*) of the fastening block (22) located on an inner side of the ski.

9. Device according to claim 7, comprising two rear fastening blocks (21, 22) placed respectively on each side of a longitudinal rib (24) for guiding and centering the boot.

10. Device according to claim 6, wherein a front support surface (21*a*) of said at least one rear fastening block (21) located on an outer side of the ski is positioned more towards the rear with respect to the front support surface (22*a*) of the fastening block (22) located on an inner side of the ski.

11. Device according to claim 6, comprising two rear fastening blocks (21, 22) placed respectively on each side of a longitudinal rib (24) for guiding and centering the boot.

12. Device according to claim 10, comprising two rear fastening blocks (21, 22) placed respectively on each side of a longitudinal rib (24) for guiding and centering the boot.

* * * * *

UNITED STATES PATENT AND TRADEMARK OFFICE

CERTIFICATE OF CORRECTION

PATENT NO. : 4,909,531

DATED : March 20, 1990

INVENTOR(S) : Gerard Graillat

It is certified that error appears in the above-identified patent and that said Letters Patent is hereby corrected as shown below:

Col. 5, claim 3, line 12, "or" should read --of--.

Signed and Sealed this

Fifth Day of November, 1991

*Attest:*

HARRY F. MANBECK, JR.

*Attesting Officer*

*Commissioner of Patents and Trademarks*